US005221094A

United States Patent [19]

Hanson

[11] Patent Number: 5,221,094

[45] Date of Patent: Jun. 22, 1993

[54] COVER UP PUZZLE GAME

[76] Inventor: Mark Hanson, 1373 Razorbill La., Punta Gorda, Fla. 33983

[21] Appl. No.: 919,280

[22] Filed: Jul. 27, 1992

[51] Int. Cl.[5] ..... A63F 9/18

[52] U.S. Cl. ..... 273/431

[58] Field of Search ..... 273/430, 284, 429, 240, 273/459, 282.2, 283, 273, 431, 432; 434/348, 347, 333

[56] References Cited

U.S. PATENT DOCUMENTS

| | | | |
|---|---|---|---|
| 3,110,499 | 11/1963 | Boeskool | 434/348 X |
| 3,347,549 | 10/1967 | Jackson | 273/284 X |
| 3,732,629 | 5/1973 | Spitzner | 434/348 X |
| 4,607,848 | 8/1986 | Maguire et al. | 273/273 X |
| 4,943,054 | 7/1990 | Palou et al. | 434/347 X |
| 5,056,793 | 10/1991 | Sigle | 273/282.2 |
| 5,094,465 | 3/1992 | Dawson | 273/429 |
| 5,112,057 | 5/1992 | Popovic | 273/432 X |
| 5,123,658 | 6/1992 | Elfanbaum | 273/430 |

FOREIGN PATENT DOCUMENTS

| | | | |
|---|---|---|---|
| 2259632 | 8/1975 | France | 273/283 |
| 2629732 | 10/1989 | France | 273/240 |
| 8802645 | 4/1988 | World Int. Prop. O. | 273/240 |

*Primary Examiner*—Paul E. Shapiro

*Attorney, Agent, or Firm*—Frank A. Lukasik

[57] ABSTRACT

A puzzle identification game wherein the individual participants attempt to be the first to identify a visual depiction of a master puzzle which depiction is initially concealed behind opaque cover up puzzle pieces lying on a transparent window and covering the master puzzle clue to the answer. The cover up puzzle consists of twenty individual, interlocking, numbered, puzzle pieces each with an assigned cash value and colored any one of ten different colors. In each game of twenty cover up puzzle pieces, there are two different pieces with the same color. Each different color represents a different general subject category of questions. Cash values are in general, higher for more central, smaller cover up puzzle pieces, and lower for more peripheral, larger cover up puzzle pieces.

4 Claims, 6 Drawing Sheets

FIRST U.S. PRESIDENT----------GEORGE WASHINGTON
SHOT ABRAHAM LINCOLN----------JOHN WILKES BOOTH
HIT MOST HOME RUNS----------HANK AARON
WROTE HAMLET----------SHAKESPEARE
YOUNGEST U.S. PRESIDENT----------JOHN KENNEDY
MOTHER OF JESUS----------VIRGIN MARY
ISLAMIC BIBLE----------KORAN
CAPITAL OF JAPAN----------TOKYO
BUILT FIRST AIRPLANE----------WRIGHT BROTHERS
INVENTED THE LIGHT BULB----------THOMAS EDISON
INVENTED THE TELEPHONE----------ALEXANDER GRAHAM BELL
LARGEST PLANET----------JUPITER
BOMBED PEARL HARBOR----------JAPANESE
HEAD NAZI LEADER----------ADOLPH HITLER
PROFESSIONAL BASEBALL CHAMPIONSHIP------WORLD SERIES
SUNSHINE STATE----------FLORIDA
WORLD'S HIGHEST MOUNTAIN----------EVEREST
LARGEST U.S. STATE----------ALASKA
PILGRIM'S SHIP----------MAYFLOWER
WORLD'S LONGEST RIVER----------NILE
LONGEST U.S. RIVER----------MISSISSIPPI
BIRTHPLACE OF JESUS----------BETHLEHEM
SIGNED JULY 4, 1776----------DECLARATION OF INDEPENDENCE
JEWEL OF THE OYSTER----------PEARL
WROTE NATIONAL ANTHEM----------FRANCIS SCOTT KEY
FACE IS ON THE PENNY----------ABRAHAM LINCOLN
FACE IS ON THE DOLLAR----------GEORGE WASHINGTON
LIVES AT THE WHITE HOUSE----------U.S. PRESIDENT
DISCOVERED AMERICA----------COLUMBUS
ENGLAND'S CAPITAL----------LONDON
FRANCE'S CAPITAL----------PARIS

FIG.9

FRONT******** BACK********

Turquoise--Entertainment
Who played "Little Jo" on Bonanza? ---- Michael Landon

Pink--Religion and Philosophy
Who was Adam and Eve's first son? ----- Cain

Green--Pure Science
Its speed is 186,272 miles per second?--Light

Blue--Inventions, Technology, Applied Science
What does "NASA" stand for?----------National Aeronautics and Space Administration Yellow--Money, Business, Law, Politics, Government
This U.S. Precident is on the five dollar bill----------Lincoln Orange--Music and the Arts
He wrote the "Star Spangled Banner"----------Francis Scott Key Purple--Words, Literature, Journalism
He wrote "Moby Dick"----------Herman Melville Red--Travel, Geography, Languages
The world's highest mountain is?--------Mt. Everest Brown--Games, Sports and Recreation
Professional Ice Hockey's most prized trophy is?----------Stanley Cup White--History
He was the youngest man to be U.S. president?----------John F. Kennedy

FIG. 10

COVER UP PUZZLE GAME

BACKGROUND OF THE INVENTION

1. Field of the invention

The field of invention relates to game apparatus for a group of participants each of which is competitively attempting to be the first to identify the subject matter of a concealed clue as additional portions of the clue are randomly exposed to the participants.

2. Description of the prior art

Game structures of various types have been utilized in the prior art to associate game cards and objects relative to the game cards. A number of question-and-answer or trivia games have also found favor recently. There have been several board games proposed which have a state, country, or principality as a theme.

The curiosities of the various members of our society are constantly driven to seek challenges whereby our wits, knowledge and skills can be pitted against other individuals in a competitive manner. For example, riddles, trivia quizzes, and word games have been commonly used by radio and television broadcasters as well as newspaper and magazine publishers to accomplish one or more of these objectives. Many times these applications are presented in a serial manner with additional hints provided sequentially to entice and induce greater interest as individuals repeatedly return to the same media to participate in and to remain cognizant of the progressive development toward an ultimate solution and conclusion.

One such device is shown in U.S. Pat. No. 5,056,793 to Sigle discloses a picture identification game for competitive determination of the identity of the subject matter of a partially exposed picture. The picture is initially concealed with cover pieces of opaque material removably secured in an adjacent relationship to a protective window superimposed in front of the picture. U.S. Pat. No. 4,674,752 to Brothers discloses a territory trivia game bearing a map or a representation of a particular state or territory, and that representation is divided into eight color coded sections or regions. Each section represents a different region of the state or territory. The object is to answer questions while the transit piece occupies a city station earning a collection piece. The winner of the game is the first player to earn all eight collection pieces.

U.S. Pat. No. 4,607,848 to Maguire et al discloses a game involving the guessing of concealed words through definitional and phonetic clues. When the words are properly guessed, the player covers a score board space corresponding to the random number. As play progresses, the score board spaces become full and influence strategy. The first player to fill their board wins. U.S. Pat. No. 5,094,465 to Dawson discloses a shape recognition game wherein a plural series of cards provides excessively greater clues relative to a particular configuration. Points are awarded based upon solving a random shape by the clues at a greater rate than upon earlier solving of clues.

U.S. Pat. No. 1,714,127 to Graham discloses a picture puzzle comprising a picture-bearing sheet having detachable portions each bearing a part of a complete picture and interposed non-detachable portions each bearing a part of the same complete picture. In using the puzzle, the detachable portions are removed from the device, shuffled, and then replaced a piece at a time to solve the puzzle.

U.S. Pat. No. 2,175,591 to Beneteau discloses an educational game of the geographic type. U.S. Pat. No. 3,377,071 to Treinis discloses a puzzle game wherein the player may be provided with clues and, based upon the clues, may manipulate the parts of the device to work out a solution.

SUMMARY OF THE INVENTION

A puzzle identification game is provided to challenge individual participants to be the first to identify a visual depiction of a master puzzle which depiction is initially concealed behind opaque cover up puzzle pieces lying on a transparent window and covering the master puzzle clue to the answer. The cover up puzzle consists of twenty individual, interlocking, numbered, puzzle pieces each with an assigned cash value, and colored any one of ten different colors. In each game of twenty cover up puzzle pieces, there are two different pieces with the same color. Each different color represents a different general subject category of questions. Cash values are, in general, higher for more central, smaller cover up puzzle pieces, and lower for more peripheral, larger cover up puzzle pieces.

The master puzzle is located underneath the cover up puzzle and consists of various questions to see and solve. As questions to cover up puzzle pieces are correctly answered, the corresponding cover up puzzle is removed to reveal part of the underlying master puzzle. The first player to correctly answer the master puzzle wins. Each question card contains ten different questions and their corresponding answers representing ten different subject categories and colored with a corresponding color. The bank consists of money arranged in multiples of $500 and $1,000.

BRIEF DESCRIPTION OF THE DRAWINGS

FIG. 9 shows examples of master puzzles and the answers.

FIG. 10 shows an example of a puzzle payoff question card.

DETAILED DESCRIPTION OF THE INVENTION

Figure 1:
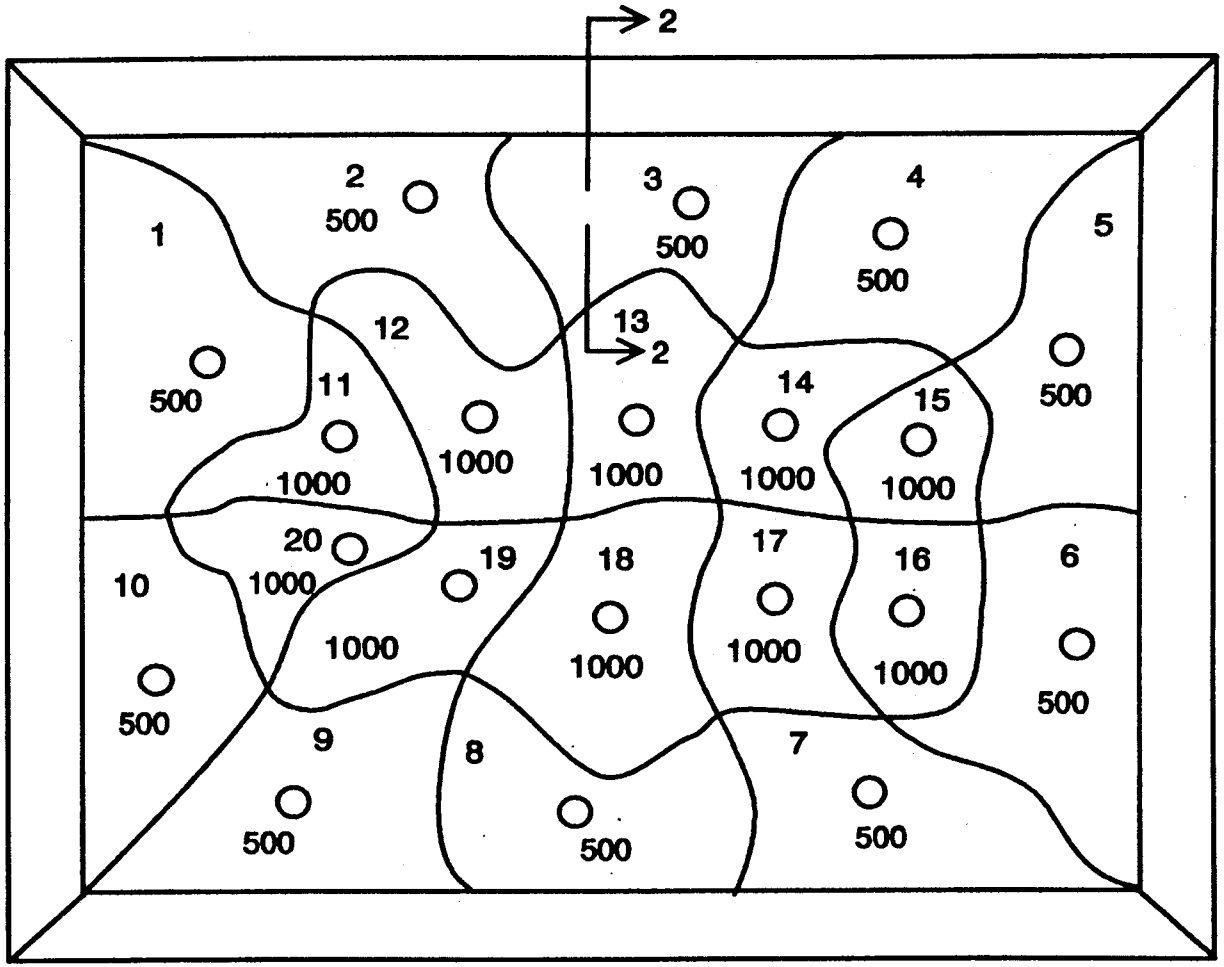
FIG. 1 is an elevational top view of the puzzle game in accordance with the invention.
Figure 2:
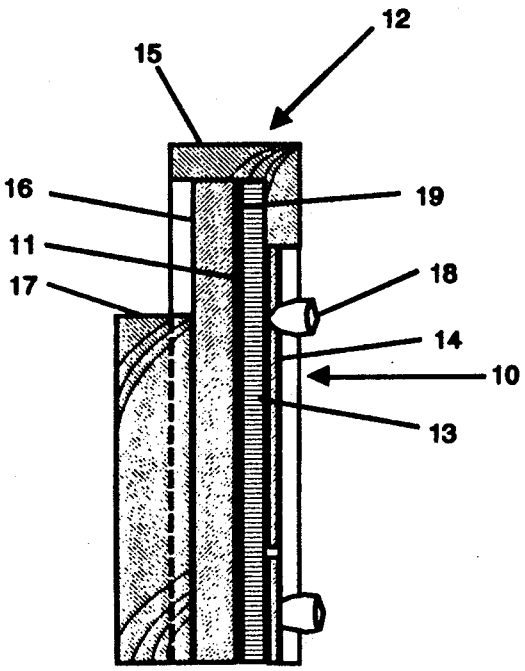
FIG. 2 is an enlarged and fragmentary cross-sectional view taken along line 2—2 of the puzzle game in accordance with the invention.

The reference numeral 10 generally refers to a cover up puzzle game apparatus in accordance with the present invention. The game 10 comprises a depiction, master puzzle 11, a means for holding and displaying master puzzle 11 such as a frame assembly 12 and window 13 which is initially concealed behind opaque cover up puzzle pieces 14 lying on a window 13 and covering the master puzzle 11 clue to the correct answer. The frame assembly 12 comprises a side edge 15, a backing board 16, a base 17 and a window 13. The frame assembly 12 is generally rectangularly shaped and is adapted to contain the backing board 16, the master puzzle 11, and the window 13 in side-by-side-abutting relationship. To replace the master puzzle 11, the upper part of frame assembly 12 is lifted up and the new master puzzle 11 is inserted on top of backing board 16 within the area between the guides 19 affixed near the edges of backing board 16. Dowels 18 are fastened to puzzle pieces 14 to facilitate picking up the pieces as they are won by the players.

The backing board 16, the base 17, and side edges 15 are constructed of rigid material such as wood, or corrugated cardboard, or plastic, or the like. The window 13 may be constructed of a rigid transparent material, such as glass, plastic oar other suitable material.

Figure 8:
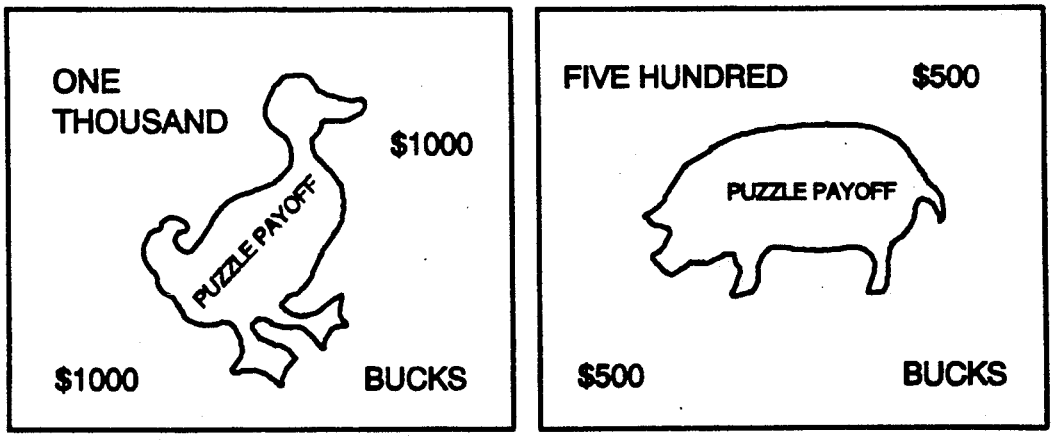
FIG. 8 shows examples of dollar payoffs won by picking cover up puzzle pieces.

The cover up puzzle game 10 consists of twenty, individual, interlocking, numbered puzzle pieces 14 each with an assigned cash value, and colored any one of ten different colors. In each game of twenty cover up puzzle pieces 14, there are two different pieces with the same color. Each different color represents a different general subject category of questions. Cash values are, in general, higher for more central, smaller cover up puzzle pieces 14, and lower for more peripheral, larger, pieces 14. An example of money used in the game 10 of the invention is shown in FIG. 8. In a preferred embodiment, the ten different color and subject categories were as follows:

| | |
|---|---|
| Turquoise | Entertainment |
| Pink | Religion and Philosophy |
| Green | Pure Science |
| Blue | Inventions, Technology, Applied Science |
| Yellow | Money, Business, Law, Politics, Government |
| Orange | Music and the Arts |
| Purple | Words, Literature, Journalism |
| Red | Travel, Geography Languages |
| Brown | Games, Sports, Recreation |
| White | History |

The master puzzle 11 is located underneath the cover up puzzle and consists of various questions to see and solve. As questions to cover up puzzle pieces 14 are correctly answered, the corresponding piece 14 is removed to reveal part of the underlying master puzzle 11. The first player to correctly answer the master puzzle wins. PUZZLE PAYOFF TM master puzzles 11 are short phrases which are uncovered by removing cover up puzzle pieces 14. A list of examples of master puzzles 11 and the answers thereto are shown in FIG. 9.

Each question card 20, as shown in FIG. 10, contains ten different questions and their corresponding answers representing ten different subject categories and colored with a corresponding color. The money used for scoring the game, consists of money arranged in multiples of $500 and $1,000 denominations.

When beginning an actual use of the game 10, the game generally appears substantially as indicated in FIG. 1 such that the master puzzle 11 is entirely concealed from view. The cover up puzzle is arranged so that the master puzzle is never seen by any player prior to play. One method of determining the order of play is to begin by randomly reading cover up puzzle questions. The first player to answer a question correctly will begin play by choosing a cover up puzzle piece to be solved.

Figure 3:
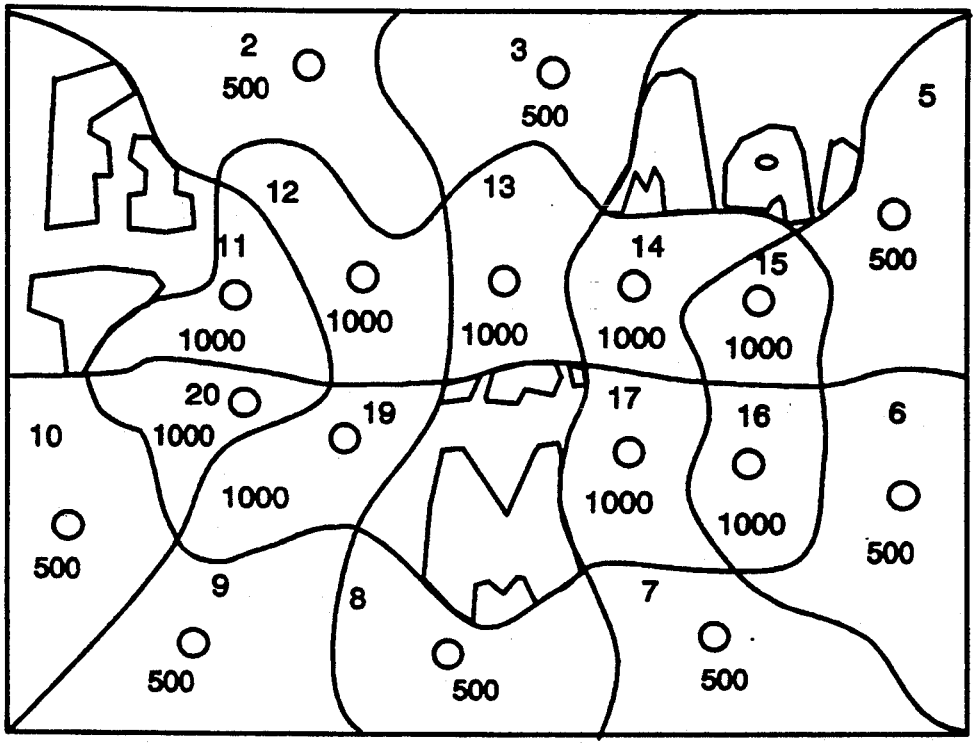
FIGS. 3 through 7 are examples of the steps of removing cover up puzzle pieces to reveal the master puzzle.

The starting player chooses a cover up piece for any player to answer. When a cover up puzzle piece 14 is selected, its number, color, and subject category is said out loud for the other players to hear. A question card is selected and the question corresponding in color to the color of the cover up piece 14 is read. The first player to signal is allowed to attempt an answer. Upon a correct response, the particular cover up puzzle piece 14 in question is removed to reveal a portion of the underlying master puzzle 11 underneath. In the example in FIG. 3, the following cover up puzzle pieces 14 have been correctly answered and removed: #1, #4, and #18. Part of the underlying master puzzle is starting to be revealed but at this time not enough of the master puzzle 11 has been exposed to solve the master puzzle 11 and win the game.

Figure 4:
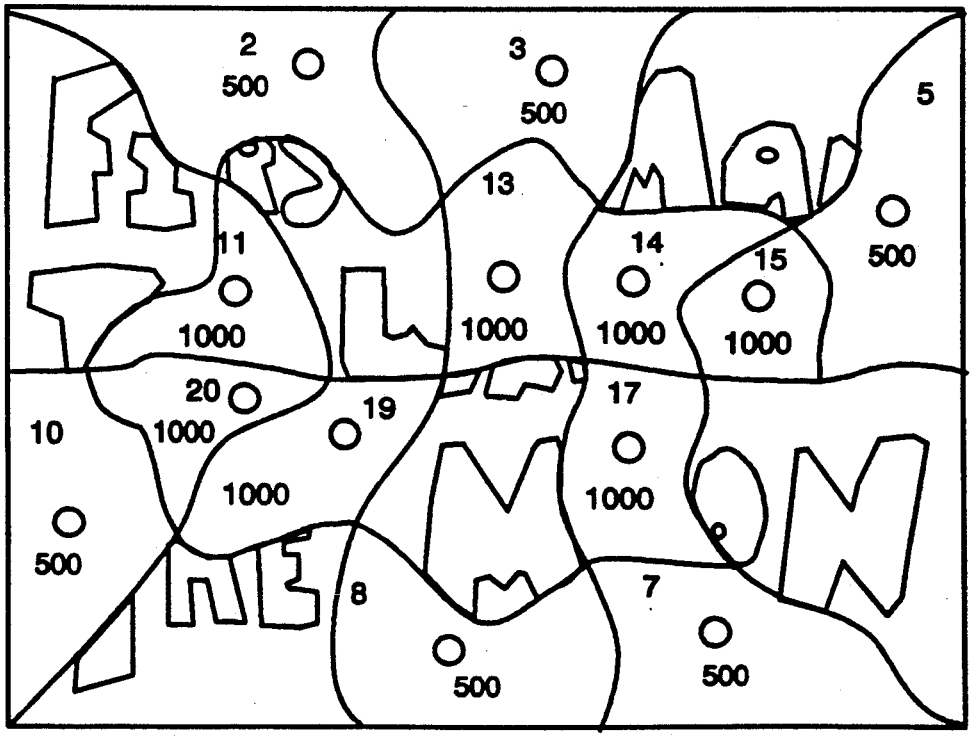

In the example in FIG. 4, the following cover up puzzle pieces 14 have been removed: #1, #4, #6, #9, #12, #16, and #18 have been correctly answered and removed. More of the underlying master puzzle 11 has been revealed but still not enough has been revealed of the master puzzle to solve it and win.

Figure 5:
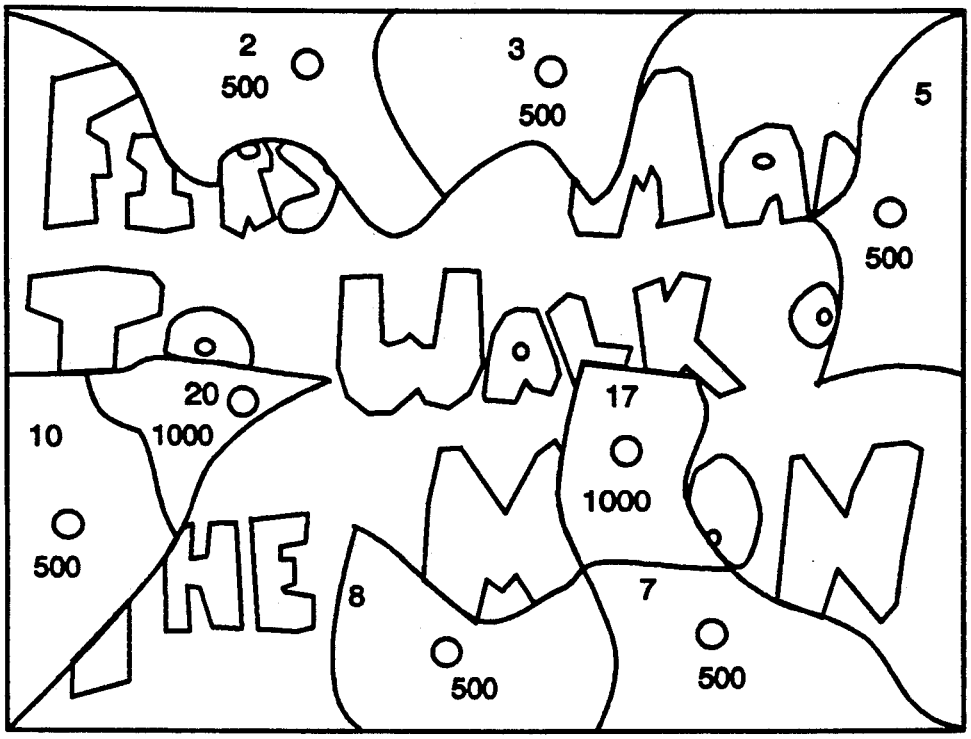

In the example in FIG. 5, the following cover up puzzle pieces 14 are remaining: #2, #3, #5, #7, #8, #10, #17, and #20. At this time, probably enough of the underlying master puzzle 11 has been revealed to read it and solve it. The first player to correctly answer a cover up puzzle piece 14 question has the first chance at correctly answering the master puzzle to win.

Figure 6:
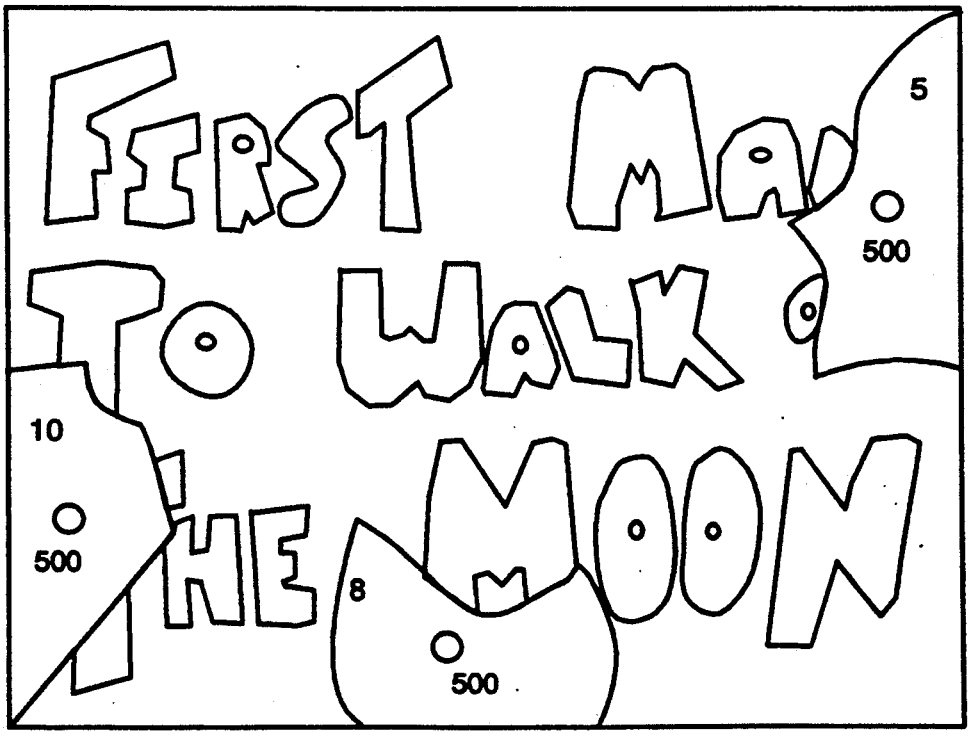
Figure 7:
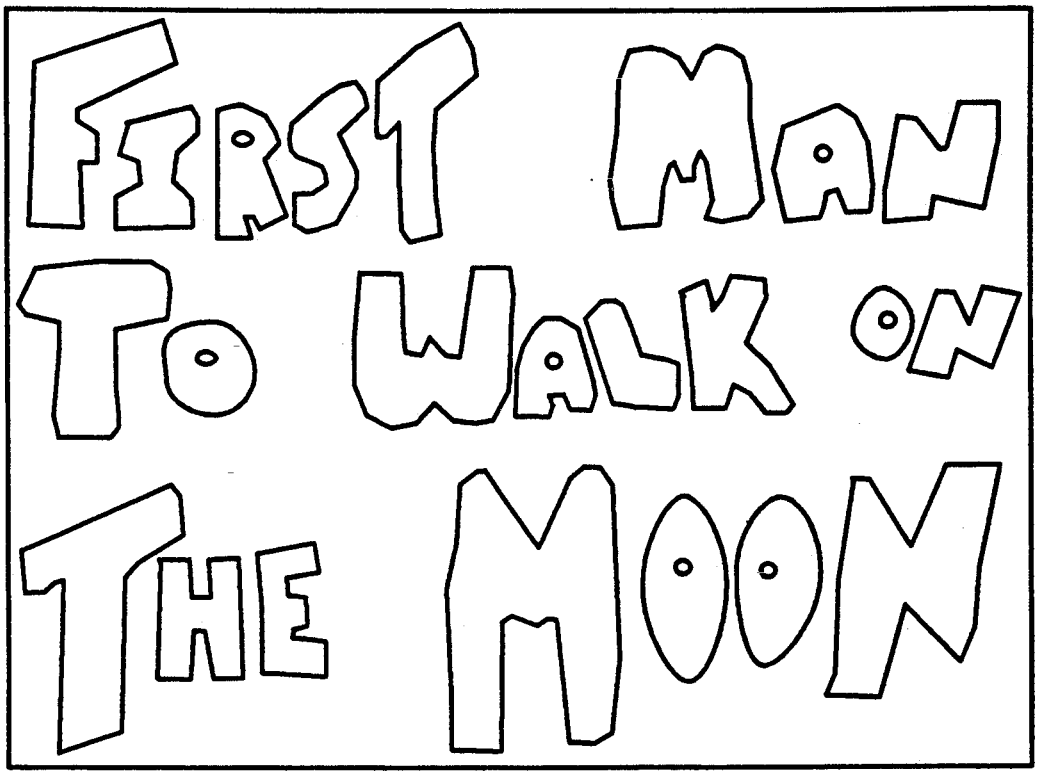

In the example in FIG. 6, only cover up pieces #5, #8, and #10 remain. In FIG. 7, all of the cover up puzzle pieces 14 have been removed. The master puzzle is: "Who was the first man to walk on the moon?" The player who first answered "Neil Armstrong" would have won.

There are several variations of the game when the master puzzle is solved:

-The one correctly solving the master puzzle wins the total value of each of the correctly solved cover up puzzle pieces 14. The other players win nothing;

-The one correctly solving the master puzzle wins the total of each of his correctly answered pieces 14 plus the sum totals of the pieces which have been solved by the other players too. The other players receive the sum totals of the pieces they have correctly solved.

-The player correctly solving the first master puzzle wins twice the total value of all money won by all the players. The other players receive just the sum total of their correctly won pieces or nothing at all. The player solving the second master puzzle wins three times the value of all money won, the other players win the total value of their pieces or nothing at all. The player winning the third master puzzle wins four times the value of the total money won by all the players, the other players win the value of their pieces or nothing at all. Winners of the fourth master puzzle win five times the total money won, the other players win the value of their pieces or nothing at all.

-It may be decided before play begins, to play only a specified amount of time. As many games as can be played in that specified amount of time are played. The player with the most money at the end of that time limit wins and is allowed to play in a special puzzle payoff event. This adaptation is very appropriate for the television version of puzzle payoff.

It will be decided at the start of the game if incorrect responses to cover up puzzle questions will carry a penalty of the loss of the value of the piece attempted form the total of the amount of money that the player has already won. At no time will negative values be carried to subsequent games. If a player solves the master puzzle but has a negative amount of cash, a minimum amount will still be awarded. This minimum amount will be decided upon at the start of the game. When a player incorrectly answers a cover up puzzle or master puzzle question, play will continue by having the player with the least amount of cash select the next cover up puzzle piece for all players to solve.

Bonuses- at certain times throughout the game, certain master puzzles will contain bonuses. These will appear when the cover up puzzle piece is correctly answered and removed and subsequently found on the master puzzle. Examples will include such things as vacations, trips, furniture, cars, boats, money, jewels, etc. If a player correctly guesses a cover up puzzle piece 14 and a bonus is found underneath when that piece is removed, that person will win the bonus only if they continue on and solve the master puzzle. There will be no bonuses for players who do not correctly guess the master puzzle.

VARIATIONS OF GAMES-

YOUNGSTERS PUZZLE PAYOFF

This embodiment is designed for small children with possible subject categories being basic learning skills, such as math, reading, spelling, punctuation, etc., manners and politeness, safety questions (don't talk to strangers, dealing with emergencies—fire, poison, etc.). The cover up puzzle pieces will be assigned values relevant to children. They may have actual cash values (one cent, five cents, ten cents, etc.). Bonuses which are appropriate to children may also be included. Master puzzles will be items easily solved by young children.

BIBLE PUZZLE PAYOFF

This game is designed for those who enjoy bible games. All questions are of a biblical nature. Values of cover up puzzle pieces 14 are still cash or may include other items of value. Master puzzles will also be of a Biblical nature. Categories of cover up puzzle pieces may include Biblical geography, Old Testament, New Testament, Memory Verses, etc.

TELEVISION VERSION OF PUZZLE PAYOFF

Because only a limited amount of time is available, play will continue up until a designated time to stop has occurred. At this time the player with the most cash will be declared the winner and will be allowed to participate in the last and final part of the T.V. game: Trying to solve the final "Jackpot Master Puzzle." The Jackpot Master Puzzle is no different than any other master puzzle in difficulty. The cover up puzzle will consist of twenty separate pieces each worth a value of $1,000 for a total game of $20,000. The player will choose which cover up pieces he wants to have removed while he tries to solve the underlying master puzzle. The grand prize consists of the total money of any remaining cover up pieces that have not been removed—i.e. the more cash is won when the fewer pieces are needed to solve the Jackpot Master Puzzle. If only five cover up puzzle pieces are necessary to be removed to see and solve the underlying Jackpot Master Puzzle, the player will win $15,000. If ten cover up puzzle pieces are necessary to be removed to solve the Jackpot Master Puzzle, the player will win $10,000.

It is to be understood that while certain forms of the present invention have been illustrated and described herein, it is not to be limited to the specific forms or arrangement of parts described and shown.

I claim:

1. A cover up puzzle game comprising:

a plurality of question cards, each card having on one side a plurality of questions and on the other side their corresponding answers representing a plurality of different subject categories each colored with a corresponding color, a plurality of master puzzle means, each of said puzzle means depicting a solution to said master puzzle means, frame means having a side edge, a window, a backing board, and a base, said backing board having a first and a second side and having a guide affixed on the outer edge of said first side of said backing board and forming a rectangular outline for and holding said master puzzle means, said base affixed to said second side of said backing board, said window contiguous to said guide and overlying said master puzzle means, said side edge forming a receptacle for said backing board, a plurality of interlocking, numbered, puzzle pieces each with an assigned prize value, and colored any one of a plurality of different colors corresponding to said question card colors, said puzzle pieces arranged on said window for initially completely concealing said master puzzle and each of said cover pieces separately and individually removable from said window such that a portion of said master puzzle exposed by such removal of one of said puzzle pieces can be associated only with those portions of said master puzzle exposed by previous removal of other puzzle pieces, and scoring means for keeping score of the number of correct answers to said questions and correct solutions for said master puzzles.

2. A cover up puzzle game as described in claim 1 wherein said scoring means consists of money arranged in multiples of $500 and $1,000 denominations.

3. A cover up puzzle game as described in claim 1 wherein said plurality of puzzle pieces consists of twenty pieces and colored any one of ten different colors.

4. A cover up puzzle game comprising:

a plurality of question cards, each card having on one side a plurality of questions and on the other side their corresponding answers representing a plurality of different subject categories each colored with a corresponding color, a plurality of master puzzles, each of said puzzles depicting a solution to said master puzzles, a puzzle holding frame having a side edge, a window for viewing a master puzzle, a backing board for holding a master puzzle, and a base, said backing board having a first and a second side and having a guide affixed on the outer edge of said first side of said backing board and forming a rectangular outline for said master puzzle, said base affixed to said second side of said backing board, said window contiguous to said guide and overlaying said master puzzle, said side edge forming a receptacle for said backing board, at least twenty interlocking, numbered, puzzle pieces, each having a dowel knob, and each with an assigned prize value, and colored any one of a plurality of different colors corresponding to said question card colors, said puzzle pieces arranged on said window for initially completely concealing said master puzzle and each of said cover pieces separately and individually removable from said window such that a portion of said master puzzle exposed by such removal of one of said puzzle pieces can be associated only with those portions of said master puzzle exposed by previous removal of other puzzle pieces, and scoring means for keeping score of the number of correct answers to said questions and correct solutions for said master puzzles and determining the winner of said game.

* * * * *